United States Patent [19]

Hte, et al.

[11] Patent Number: 5,044,567

[45] Date of Patent: Sep. 3, 1991

[54] SCRAP CRUSHING MACHINE

[75] Inventors: Dietrich Hte, Vellmar; Josef Weber, Melsungen, both of Fed. Rep. of Germany

[73] Assignee: Thyssen Industrie AG, Essen, Fed. Rep. of Germany

[21] Appl. No.: 457,332

[22] Filed: Dec. 27, 1989

[30] Foreign Application Priority Data

Dec. 27, 1988 [DE] Fed. Rep. of Germany ..... 3844005

[51] Int. Cl.[5] ..... B02C 17/00

[52] U.S. Cl. ..... 241/73; 241/82; 241/88.4; 241/186.3; 241/189 R

[58] Field of Search ..... 241/73, 88.4, 189 R, 241/186.2, 186.3, 82

[56] References Cited

U.S. PATENT DOCUMENTS

| | | | |
|---|---|---|---|
| 977,799 | 12/1910 | Hiller | 241/101.3 X |
| 1,440,429 | 1/1923 | Williams . | |
| 2,031,683 | 2/1936 | Armstrong | 241/82 |
| 2,666,589 | 1/1954 | Danyluke . | |
| 3,904,134 | 9/1975 | Olson | 241/189 R X |
| 4,009,836 | 3/1977 | Strom et al. | 241/73 |
| 4,146,184 | 3/1979 | Whitney | 241/73 |
| 4,557,421 | 12/1985 | Probst et al. | 241/73 |
| 4,720,051 | 1/1988 | Graveman et al. | 241/186.3 |
| 4,813,620 | 3/1989 | Engelmohr et al. | 241/186.2 X |

FOREIGN PATENT DOCUMENTS

| | | |
|---|---|---|
| 680966 | 9/1939 | Fed. Rep. of Germany . |
| 1272091 | 5/1973 | Fed. Rep. of Germany . |
| 2622334 | 12/1977 | Fed. Rep. of Germany . |
| 7737322 | 7/1978 | France . |
| 8209019 | 12/1983 | France . |

*Primary Examiner*—Mark Rosenbaum
*Assistant Examiner*—Frances Chin
*Attorney, Agent, or Firm*—Michael J. Striker

[57] ABSTRACT

A scrap crushing machine comprises crushing device including a crusher rotor and at least one associated anvil, a housing accommodating the crushing device, the housing having an inlet opening and an outlet opening, a base arranged substantially under the rotor and extending from the inlet opening to the outlet opening, and an upper cover arranged substantially above the rotor and extending from the outlet opening to the inlet opening so as to define with the rotor a return chamber, separating device arranged in the outlet opening, an outlet connected with the outlet opening, and a flap arranged behind the rotor as considered in direction of rotation of the rotor and having a separating edge. The flap is swivelable to at least one operating position in which it feeds sufficiently crushed scrap pieces passing through the separating device mainly to the outlet and feeds insufficiently crushed scrap pieces mainly to the return chamber, the flap being also swivelable to an open position in which insufficiently crushed scrap pieces are also fed to the outlet.

14 Claims, 2 Drawing Sheets

SCRAP CRUSHING MACHINE

BACKGROUND OF THE INVENTION

The present invention relates generally to scrap crushing machines. More particularly, it relates to a scrap crushing machine which has crushing means including a hammer crusher rotor and an associated anvil, and a housing having inlet and outlet openings, a base extending under the rotor between the openings and the cover extending above the rotor between the openings, and also a separating device arranged at the outlet opening and a flap associated with the outlet opening as well.

Scrap crushing machines of the above mentioned general type are known in the art. One of such scrap machines is disclosed, for example,, in the German document DE-PS 3,643,529 corresponding to U.S. Pat. no. 4,146,184. In the housing of this scrap crushing machine, a separating edge of the flap which follows a screen wall of the base in direction of rotation of the rotor, deflects the scrap pieces which are not yet sufficiently crushed to a return chamber formed between the cover and the rotor so as to return them to the anvil. At the same time, it guides the scrap pieces which are not sufficiently crushed to the outlet of the machine, insofar as they enter channels formed between ribs of the separating device. The effective height of the ribs of the separating device can be changed either by swiveling the screen wall of the device relative to a rigidly arranged separating edge or by swiveling the separating edge relative to a rigidly arranged screen wall.

In the processing of scrap in the form of automobile bodies, or the like, it is often necessary to remove hard and/or large pieces of scrap from the housing while the rotor is running, in order to prevent damage to functional parts of the crushing machine. For this purpose in the above mentioned housing, it is known to support the screen wall in such a way that it can be swiveled around an axis arranged in the lower area, to an open position so as to open the outlet while the rotor is running. However, such a swivelable support is undesirable because of the high forces exerted by the scrap pieces, particularly on the lower portion of the screen wall. It also results in the scrap pieces impacting against the rigid separating edge in an uncontrolled manner when the screen wall is in the open position, which impedes a quick and complete removal of all scrap pieces located in the housing.

SUMMARY OF THE INVENTION

Accordingly, it is an object of the present invention to provide a scrap crushing machine which avoids the disadvantages of the prior art.

More particularly, it is an object of the present invention to provide a scrap crushing machine with a housing constructed so that a swiveling of the screen wall is no longer necessary for a quick emptying of the housing.

In keeping with these objects and with others which will become apparent hereinafter, one feature of the present invention resides, briefly stated, in a scrap crushing machine in which the flap is additionally swivelable to an open position in which insufficiently crushed scrap pieces are also fed to the outlet of the machine.

When the flap is designed in accordance with these features the above mentioned disadvantages of the prior art are eliminated. The screen wall can be arranged in a completely rigid manner if desired. Nevertheless, a reliably division of the material flow into a partial flow containing large scrap pieces and a partial flow containing small scrap pieces is possible in the operating position of the flap, and a quick emptying of the housing is possible in the open position of the flap.

In accordance with another feature of the present invention, the flap can comprise two wedge surfaces arranged in a wedge-shaped manner and forming the separating edge, and the flap can be supported so as to be swivelable so that one of the edge surfaces forms a deflecting surface leading from the separating edge to the cover in the operating position, and one of the wedge surfaces forms an ejecting surface guiding insufficiently crushed scrap pieces to the outlet in the open position.

The deflecting surface and the ejecting surface can be formed by the same wedge surface of the flap. The other wedge surface can be formed as an ejecting surface for sufficiently crushed scrap pieces when the flap is in the closed position.

On the other hand, the deflecting, surface can be formed by one wedge surface, while the ejecting surface can be formed by the other wedge surface. Also, the other wedge surface can be constructed as an ejecting surface for the insufficiently crushed scrap pieces when the flap is in the operating position.

At least one of the wedge surfaces can be curved. More particularly, it can be curved so that is distance from the rotor becomes gradually greater in direction of the cover when the flap is in the operating position.

The inner surface of the cover can be spaced from the rotor by a distance which becomes increasingly smaller in direction toward the inlet opening. This inner surface can be arc-shaped.

Finally, the deflecting surface of the flap can form a continuous extension of the inner surface of the cover when the flap is in the operating position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
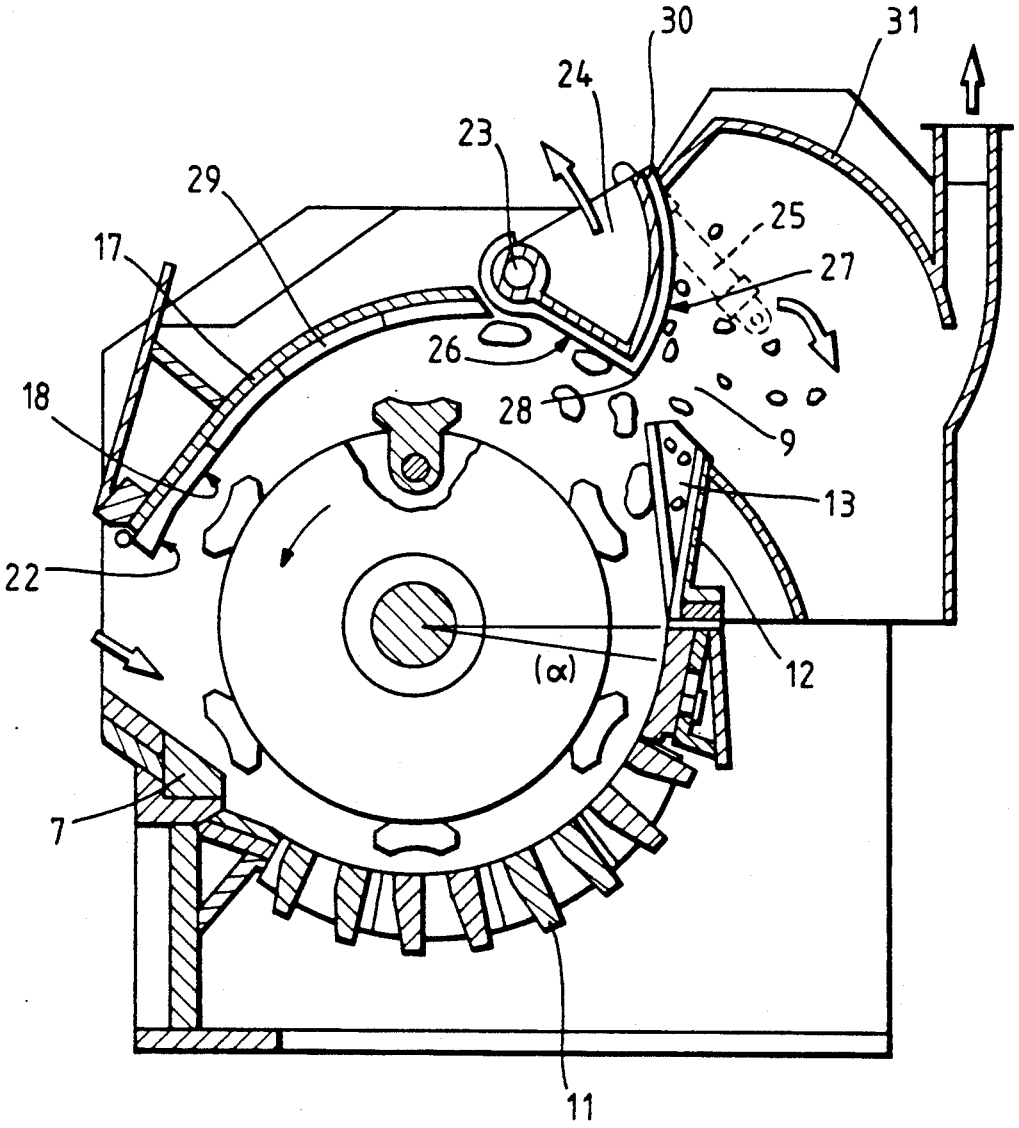
FIG. 1 is a view showing a vertical section of a scrap crushing machine with a flap in an operating position.

A scrap crushing machine in accordance with the present invention has a hammer crusher rotor 1 rotatable with a horizontal rotation axle 2 which is supported in a housing. The rotor 1 is provided with a plurality of hammers 3 which are distributed over its circumference and fastened so as to be swivelable around their axles 4 arranged parallel to the rotation axle 2. During operation of the scrap crushing machine, the material to be crushed, such as for example automobile bodies, refrigerators or the like are fed in direction of the arrow 8 through an inlet opening 6 of the housing and crushed by cooperation of the hammer 3 with an anvil 7 located near the inlet opening 6. The crushed material leaves the housing through an outlet opening 9 located approximately diametrically opposite to an inlet opening 6 and connected with an outlet 10.

A base 11 is arranged substantially below the rotor 11 and formed in the shown embodiment as a grate. The base 11 extends from the inlet opening 6 to the outlet opening 9 and immediately sorts out small parts, dirt and the like. The outlet opening 9 is partially overlapped by a separating device. The separating device includes a substantially vertically arranged screen wall 12 which is rigidly mounted in the housing. The screen wall 12 is formed as an extension of the base 11 and extends along the whole length of the housing in direction parallel to the rotation axle. The side walls of the housing located at both axial ends of the rotor 1 are not shown in the drawings.

The screen wall 12 is provided with a plurality of ribs 13 which are arranged at its side facing the interior of the housing. The ribs 13 form a plurality of parallel channels which divide the material flow of scrap pieces exiting tangentially from the gap between the base 11 and the rotor 1, into a corresponding plurality of partial flows. The partial flows can only contain scrap pieces which are already sufficiently crushed or in other words are smaller than the distance between the ribs 13. These partial flows are again reunited in the outlet 10 formed as a collecting chamber. The scrap pieces or similar material passing the base 11 can fall from the collecting chamber onto a conveyor belt or other transporting element through a lower housing opening 15 by force of gravity.

The height of the ribs 13 in a direction perpendicular to the rotation axle 2, increases in a wedgeshaped manner from the bottom up. Thereby those scrap pieces which are still not sufficiently crushed or which impact against the ribs 13 are directed into a return chamber 16. The return chamber 16 is formed behind the outlet opening 9 in the direction of rotation of the rotor 1 by the end faces of the ribs 13 extending tangentially to the rotor 1 and acting as guide surfaces.

The above described scrap crushing, machine and its operation are known from U.S. Pat. No. 4,146,184 and therefore are not discussed in more detail.

The housing of the inventive scrap crushing machine has further an upper cover 17 which is arranged substantially above the rotor 1. The cover 17 extends from the outlet opening 9 to the inlet opening 6 and limits the return chamber 16. The cover 17 has an inner surface 18 which faces the rotor 1 and is spaced from the latter by a distance gradually decreasing in direction toward the inlet opening 6 from a point inside the return chamber 16 at which it is at its greatest distance from the rotor 1. In the shown embodiment this is achieved by means of an arc-shaped, substantially convex cross-section of the entire cover 17. The cover 17 can be formed, for example as a steel plate. The scrap pieces which do not pass through the screen wall 12 are fed again from the point where they leave the ribs 13, along a continuous arc to the hammers 17 rotating along an orbit or cylinder surface 19. They are returned into the space between the orbit 19 and an outer surface area of the rotor 1 without abruptly impacting against one another or against parts of the cover 17. During this process they substantially lose velocity and kinetic energy and must be accelerated again by the rotor 1. The scrap pieces in their entirety move therefore in substantially the same manner as the fluid flow from the outlet opening 9 back to the inlet opening 6. Nevertheless, the scrap pieces can rotate around themselves to the desired extent in the return chamber 16. This is advantageous for the subsequent crushing process in the effective area of the anvil 7.

The aforementioned distance of the inner surface 18 can be selected in relation to the rotation axle 2, the orbit 19 or the outer surface area 30 of the rotor 1. The arcshaped construction of the inner surface 18 can be formed for example by a cylindrical, parabolic, elliptical or hyperbolic surface or the like.

The inner surface 18 has an end portion located close to the inlet opening 6 and constructed as a guide surface 22. The guide surface 22 guides the returned scrap pieces in such a way that they enter into the gap between the anvil 7 and the rotor 1 in a desired manner in the area of the inlet opening 6.

A flap 24 is located at the end of the cover 17 facing the outlet opening 9. It is swivelably supported in the housing by means of a swivel axle 23. The flap 24 can be swiveled by a hydraulic cylinder-piston unit 25 or the like and has two legs which are arranged in a V-shaped manner relative to one another. The legs of the flap 24 have outer wedge surfaces 26 and 27 ending in a point which forms a separating edge 28 extending parallel to the rotation axle 2. The wedge surface 26 has preferably an arc-shaped, slightly concave form, while the wedge surface 27 has an arc-shaped or slightly convex form with reference to the swivel axle 23.

The angle between the wedge surfaces 26 and 27 and their lengths are selected so that in the operating position of the flap 24 shown in FIG. 1, the wedge surface 26 partially overlaps the outlet opening 29 and preferably extends up to the vicinity of the upper end of the screen wall 12, thus forming an immediate and direct continuation of the inner surface 18 of the cover 17. Therefore, it acts as a deflecting surface for the scrap pieces which are not sufficiently crushed. On the other hand, the other wedge surface 27 in this position of the flap 24 can act simultaneously as an ejecting surface for the sufficiently crushed scrap pieces passing through the screen wall 12 and can deflect them in the direction to the outlet 10. Therefore, a reliable separation of the large and small scrap pieces can be achieved with simple means. Moreover, the separating edge 28 can be brought to another operating position or relative position to the screen wall 12 by a slight swiveling of the flap 24. Thereby the maximum size of the scrap pieces passing through the outlet opening 9 can be changed.

Figure 2:
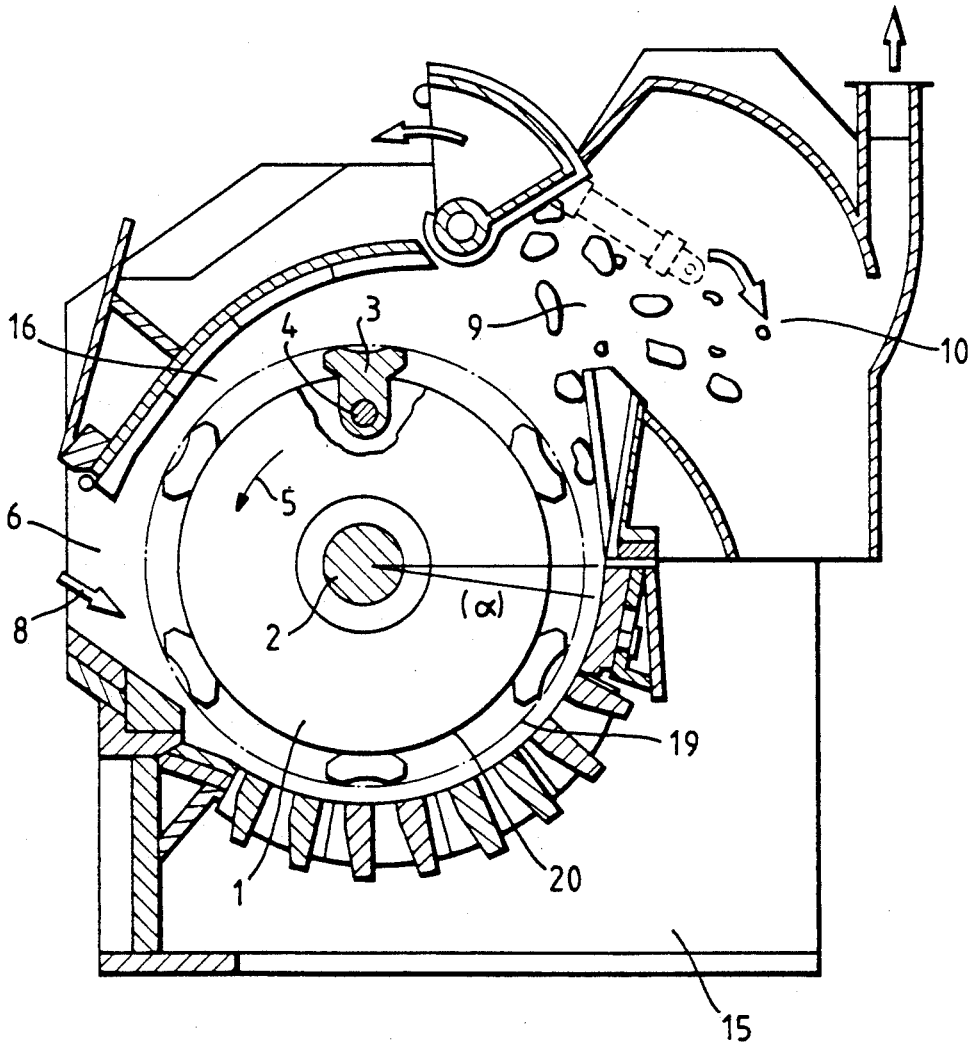
FIG. 2 is a view showing a vertical section corresponding to the vertical section of FIG. 1, but showing the flap in an open position.

When the flap 24 is swiveled to an open position shown in FIG. 2, a complete removal of all scrap pieces from the housing can be performed. The wedge surface 26 acts as an ejecting surface for the sufficiently crushed scrap pieces, since the shape of the flap 24 and the position of its swivel axle 23 are selected so that substantially all scrap pieces which are not yet sufficiently crushed and which are detached from the rotor 1 and thrown into the return chamber 16 impact against the wedge surface 26 and are deflected by the latter in direction to the outlet 10. The sufficiently crushed scrap pieces reach the outlet 10 through the screen wall 12 and accordingly can be deflected in the outlet direction by means of the wedge surface 26. For this purpose the shape of the wedge surface 26 and the position of the swivel axle 23 arranged in the area of the portion of the flap 24 adjoining the cover 17 in the shown embodiment, are preferably selected so that scrap pieces deflected by the wedge surface 26 do not lose all their kinetic energy by striking against one another or against the wedge surface 26 itself and then fall into the return chamber 16. Rather, they arrive in the outlet 10 through the screen wall 12. Advantageous geometric proportions can be achieved in particular when the end of the cover 17 immediately adjoining the flap 24 is at the greatest distance from the rotor.

The utilization of the flap 24 has two important advantages. First of all, it enables a completely rigid arrangement of the screen wall 12 and at the same time makes possible quick emptying of the housing of the machine. On the other hand, it makes it possible to keep the inner wall portion of the housing situated above the rotor 1 free of projecting corners or edges at which the scrap pieces are abruptly decelerated and could accordingly lose their kinetic energy. The housing in its entirety also preferably has no abrupt cross-sectional reductions in the flow path of the scrap pieces in the area of the return chamber 16 which could cause a bottleneck. The scrap pieces not exiting through the outlet opening 9 are therefore very gradually and "gently" fed into the effective area of the rotor 1 again after entering the return chamber 16, and then they are transported from this effective area of the rotor 1 to the anvil 7 located near the inlet opening 6. The continued crushing of these scrap pieces is performed accordingly at the anvil 7 near the inlet opening 7.

The inner surface 18 and the wedge surfaces 26 and 27 are preferably formed by layers or plates 29 and 30 composed of a wear resistant material. They are arranged on the cover 17 and the flap 24 and can be exchanged.

Finally, additional deflecting surfaces 31 can be provided. They reinforce the deflection of the scrap pieces by the flap 24, in direction to the outlet 10.

The invention is not limited to the above described embodiment and can be modified in many respects. For example, it is possible to support the flap 24 so as to be swivelable at the free end of the wedge surface 27, instead of at the free end of the wedge surface 26. In this case the flap 24 could be swiveled to its open position in a clockwise direction instead of the counterclockwise direction shown in FIGS. 1 and 2. The wedge surface 26 would serve in this case as a deflecting surface for the large scrap pieces in the operating position, and the wedge surface 27 would serve in an auxiliary manner as an ejecting surface for the small scrap pieces. However, in the open position of the flap 24 the wedge surface 27 would also be able to serve as an ejecting surface for both large and small scrap pieces, in contrast to FIGS. 1 and 2. Other swivel bearing points and wedge surface shapes are also possible.

It is also possible to use a screen wall 12 which is arranged in the housing in a swivelable manner as disclosed in the German reference DE-PS 3,643,529 and to control the size of the scrap pieces exiting through the outlet opening 9 by changing the position of the separating edge 28 by means of swiveling the screen wall 12 relative to the flap 24. In this case also the complete emptying of the housing could be performed when the flap 24 is in the open position. Instead of the shown screen 12, other separating devices could also be provided. More particularly, such separating devices can be provided which have a shape corresponding to or similar to the screen wall and arranged not vertically, but instead diagonally relative to the vertical line or even horizontally. insofar as it is insured that the emptying of the housing can be effected by means of directing the flap 24 to its open position.

It will be understood that each of the elements described above, or two or more together, may also find a useful application in other types of constructions differing from the types described above.

While the invention has been illustrated and described as embodied in a scrap crushing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A scrap crushing machine, comprising crushing means including a crusher rotor and at least one associated anvil; a housing accommodating said crushing means, said housing having an inlet opening and an outlet opening, a base arranged substantially under said rotor and extending from said inlet opening to said outlet opening, and an upper cover arranged substantially above said rotor and extending from said outlet opening to said inlet opening so as to define with said rotor a return chamber; separating means arranged in said outlet opening; an outlet connected with said outlet opening; and a flap arranged behind said separating means as considered in direction of rotation of said rotor and having a separating edge, said flap being swivelable, during rotation of said rotor, to at least one operating position in which said edge feeds sufficiently crushed scrap pieces passing through said separating means mainly to said outlet and feeds insufficiently crushed scrap pieces mainly to said return chamber, said flap being also swivelable to an open position in which insufficiently crushed scrap pieces are also fed to said outlet.

2. A scrap crushing machine as defined in claim 1, wherein said flap has two wedge surfaces which are arranged in a wedge-shaped manner and form said separating edge.

3. A scrap crushing machine as defined in claim 2 wherein said flap is arranged so that one of said wedge surfaces forms a deflecting surface leading from said separating edge to said cover in said operating position, and one of said wedge surfaces forms an ejecting surface guiding insufficiently crushed scrap pieces to said outlet in said open position.

4. A scrap crushing machine as defined in claim 3, wherein said deflecting surface and said ejecting surface are formed by the same one of said wedge surfaces.

5. A scrap crushing machine as defined in claim 3, wherein said deflecting surface is curved so that its distance from said rotor becomes gradually greater in direction of said cover when said flap is in said operating position.

6. A scrap crushing machine as defined in claim 3, wherein said cover has an inner surface, said deflecting surface forming a continuation of said inner surface when said flap is in said operating position.

7. A scrap crushing machine as defined in claim 2, wherein at least one of said wedge surfaces is curved.

8. A scrap crushing machine as defined in claim 1, wherein said cover has an inner surface spaced from said rotor by a distance which becomes increasingly smaller in direction toward said input opening.

9. A scrap crushing machine as defined in claim 8, wherein said inner surface of said cover is arc-shaped.

10. A scrap crushing machine as defined in claim 1, wherein said separating means includes a screen wall with a plurality of wedge-shaped ribs substantially extending tangentially to said rotor and forming a plurality of channels dividing a flow of the scrap pieces into respective partial flows, and said separating edge of said flap cooperating with said channels for adjusting a maximum size of said scrap pieces passing through said outlet opening.

11. A scrap crushing machine as defined in claim 10, wherein said flap has two edge surfaces arranged in a wedge-shaped manner and forming said separating edge.

12. A scrap crushing machine, comprising crushing means including a crusher rotor and at least one associated anvil; a housing accommodating said crushing means, said housing having an inlet opening and an outlet opening, a base arranged substantially under said rotor and extending from said inlet opening to said outlet opening, and an upper cover arranged substantially above said rotor and extending from said outlet opening to said inlet opening to define with said rotor a return chamber; separating means arranged in said outlet opening; an outlet connected with said outlet opening; and a flap arranged behind said rotor as considered in direction of rotation of said rotor and having a separating edge, said flap being swivelable to at least one operating position in which said edge feeds sufficiently crushed scrap pieces passing through said separating means mainly to said outlet and feeds insufficiently crushed scrap pieces mainly to said return chamber, said flap being also swivelable to an open position in which insufficiently crushed scrap pieces are also fed to said outlet, said flap having two wedge surfaces which are arranged in a wedge-shaped manner and form said separating edge, and said flap being arranged so that one of said wedge surfaces from a deflecting surface leading from said separating edge to said cover in said operating position, and one of said wedge surfaces forms an ejecting surface guiding insufficiently crushed scrap pieces to said outlet in said open position, said deflecting surface and said ejecting surface being formed by the same one of said wedge surfaces, another of said wedge surfaces being formed as an ejecting surface for sufficiently crushed scrap pieces when said flap is in a closed position.

13. A scrap crushing machine, comprising crushing means including a crusher rotor and at least one associated anvil; a housing accommodating said crushing means, said housing having an inlet opening and an outlet opening, a base arranged substantially under said rotor and extending from said inlet opening to said outlet opening, and an upper cover arranged substantially above said rotor and extending from said outlet opening to said inlet opening so as to define with said rotor a return chamber; separating means arranged in said outlet opening; an outlet connected with said outlet opening; and a flap arranged behind said rotor as considered in direction of rotation of said rotor and having a separating edge, said flap being swivelable too at least one operating position in which said ed ge feeds sufficiently crushed scrap pieces passing through said separating means mainly to said outlet and feeds insufficiently crushed scrap pieces mainly to said return chamber, said flap being also swivelable to an open position in which insufficiently crushed scrap pieces are also fed to said outlet, said flap having two wedge surfaces which are arranged in a wedge-shaped manner and form said separating edge, and said flap being arranged so that one of said wedge surfaces forms a deflecting surface leading from said separating edge to said cover in said operating position, and one of said wedge surfaces forms an ejecting surface guiding insufficiently crushed scrap pieces to said outlet in said open position, said deflecting surface being formed by said one wedge surface, while said ejecting surface is formed by the other of said wedge surfaces.

14. A scrap crushing machine as defined in claim 13, wherein said other wedge surface is formed as an ejecting surface for insufficiently crushed scrap pieces when said flap is in said operating position.

* * * * *

UNITED STATES PATENT AND TRADEMARK OFFICE

CERTIFICATE OF CORRECTION

PATENT NO. : 5 044 567

DATED : Sept. 3, 1991

INVENTOR(S) : Dietrich Häusler and Josef Weber

It is certified that error appears in the above-identified patent and that said Letters Patent is hereby corrected as shown below:

On the title page:

Item [75] the name of the first inventor should read:

--Dietrich Häusler--

Signed and Sealed this

Eighth Day of August, 199

*Attest:*

*Attesting Officer*

Bruce Lehman

BRUCE LEHMAN

*Commissioner of Patents and Trademarks*